US010632474B2

(12) United States Patent
Doppstadt et al.

(10) Patent No.: US 10,632,474 B2
(45) Date of Patent: Apr. 28, 2020

(54) DISINTEGRATING DEVICE COMPRISING A COMB SYSTEM

(71) Applicant: DOPPSTADT FAMILIENHOLDING GMBH, Velbert (DE)

(72) Inventors: Johann Doppstadt, Velbert (DE); Horst Berger, Calbe (DE)

(73) Assignee: DOPPSTADT FAMILIENHOLDING GMBH, Velbert (DE)

( * ) Notice: Subject to any disclaimer, the term of this patent is extended or adjusted under 35 U.S.C. 154(b) by 459 days.

(21) Appl. No.: 15/537,537

(22) PCT Filed: Dec. 7, 2015

(86) PCT No.: PCT/EP2015/002457

§ 371 (c)(1),
(2) Date: Jun. 19, 2017

(87) PCT Pub. No.: WO2016/096103

PCT Pub. Date: Jun. 23, 2016

(65) Prior Publication Data

US 2017/0361331 A1 Dec. 21, 2017

(30) Foreign Application Priority Data

Dec. 19, 2014 (DE) ..... 20 2014 009 967 U
May 18, 2015 (DE) ..... 20 2015 003 527 U

(51) Int. Cl.
*B02C 23/00* (2006.01)
*B02C 23/16* (2006.01)
(Continued)

(52) U.S. Cl.
CPC ..... *B02C 23/16* (2013.01); *B02C 13/284* (2013.01); *B02C 18/145* (2013.01); *B02C 18/18* (2013.01);
(Continued)

(58) Field of Classification Search
CPC ..... B02C 13/284; B02C 2013/165; B02C 18/145; B02C 18/2216; B02C 18/18; B02C 2018/188
(Continued)

(56) References Cited

U.S. PATENT DOCUMENTS 2,261,090 A * 10/1941 Lind ..... B02C 18/18 241/82
2,305,159 A * 12/1942 Heckman ..... A01F 12/10 460/106
(Continued)

FOREIGN PATENT DOCUMENTS

DE 19514951 10/1996
DE 29910770 11/1999
(Continued)

OTHER PUBLICATIONS

International Search Report dated Apr. 20, 2016.

*Primary Examiner* — Faye Francis
(74) *Attorney, Agent, or Firm* — Jacobson Holman, PLLC.

(57) ABSTRACT

The invention relates to a disintegrating device including a comb system (I), wherein the disintegrating device is formed by at least one disintegrating roller (1), rotatably mounted in a machine frame, with at least one disintegrating tool (2) arranged thereon, wherein the disintegrating device has at least one counter blade (3) that cooperates with the disintegrating tool (2), and including at least one base comb (II) on which the at least one counter blade (3) is arranged, and on which at least one sieve element (41) can be arranged as a component of a sieve device (4), wherein the sieve device (4) at least partially includes the disintegrating roller (1) in the intended application. According to the invention, the sieve element (41) is spring-mounted on the base comb (II).

13 Claims, 7 Drawing Sheets

(51) Int. Cl.
*B02C 18/14* (2006.01)
*B02C 13/284* (2006.01)
*B02C 18/18* (2006.01)
*B02C 18/22* (2006.01)

(52) U.S. Cl.
CPC .... *B02C 18/2216* (2013.01); *B02C 2018/188* (2013.01); *B02C 2023/165* (2013.01)

(58) Field of Classification Search
USPC ..... 241/73, 242, 243
See application file for complete search history.

(56) References Cited

U.S. PATENT DOCUMENTS 2,324,382 A * 7/1943 Goodwin ..... A23N 5/00 99/571
4,318,512 A * 3/1982 Jacobson ..... B02C 13/284 241/189.1
4,385,732 A * 5/1983 Williams ..... B02C 18/0084 241/236
4,836,457 A * 6/1989 Greiner ..... B02C 13/284 241/73
5,213,273 A * 5/1993 Linnerz ..... B02C 13/284 241/285.3
7,090,157 B2 * 8/2006 Peterson ..... B02C 13/286 241/73
7,909,277 B2 * 3/2011 Doppstadt ..... B02C 18/145 241/243
7,992,812 B2 8/2011 Doppstadt et al.
9,573,137 B2 * 2/2017 Van der Galien ..... B02C 4/34
10,099,224 B2 * 10/2018 Peterson ..... B02C 18/145
2010/0252670 A1 * 10/2010 Kitaguchi ..... B02C 18/145 241/277

FOREIGN PATENT DOCUMENTS

DE 202012004469 9/2013
SU 1444158 12/1988
WO 2013/113989 8/2013

* cited by examiner

DISINTEGRATING DEVICE COMPRISING A COMB SYSTEM

BACKGROUND OF THE INVENTION

The invention relates to a disintegrating device comprising a comb system, wherein the disintegrating device is formed by at least one disintegrating roller, rotatably mounted in a machine frame, with at least one disintegrating tool arranged thereon, wherein the disintegrating device has at least one counter blade that cooperates with the disintegrating tool, and comprising at least one base comb on which the at least one counter blade is arranged, and on which at least one sieve element can be arranged as a component of the sieve device, wherein the sieve device at least partially encircles the disintegrating roller in the intended application.

DESCRIPTION OF RELATED ART

Disintegrating devices of this kind are sufficiently known in the state of the art. The known disintegrating devices, however, have the disadvantage that the sieve elements, when used as intended, during disintegrating of material to be disintegrated loaded with solid material or rocks (over-sized material) either block or deform or damage the disintegrating roller. The result is that downtime for disintegrating devices of this kind is rather high when mixed material like this has to be disintegrated.

From the citation DE 299 10 772 U1 a disintegrating device has been known comprising stationary, comb-like arranged teeth. This citation describes that the stationary teeth are formed by at least one plate, wherein the plate is supposed to be clamped hydraulically in the centered position to a carrier. A springy support that could prevent the teeth of the disintegrating device from damage or destruction cannot be seen in this citation.

Furthermore, in the citation DE 20 2012 004 469 U1 a disintegrating device with a swiveling sieve basket cassette is described. Also citation U.S. Pat. No. 7,992,812 B2 is known from the state of the art. Here also exist the disadvantages as described in the beginning with reference to the state of the art.

BRIEF SUMMARY OF THE INVENTION

Therefore, it is an object of the invention to suggest a disintegrating device that does not have the before-described disadvantages.

The problem of the invention is solved by a disintegrating device with a comb system, wherein the disintegrating device consists of at least one disintegrating roller rotatably mounted in a machine frame with at least one disintegrating tool arranged thereon, wherein the disintegrating device has at least one counter blade interacting with the disintegrating tool, with at least one base comb on which the at least one counter blade is arranged, and on which at least one sieve element can be arranged as part of a sieve device, wherein the sieve device, when applied as intended, encircles at least partly the disintegrating roller, characterized in that the sieve element is spring-mounted on the base comb. The springy support allows that during the disintegrating process the sieve elements are able to recede as they can move back because of the springy support when over-sized material enters. This reliably prevents the sieve elements from damage during the intended application. The particular shape of the sieve elements (also denoted limiter comb extension elements) follows the radius of the disintegrating roller so that over-sized material is lead around the disintegrating roller with a slight pre-pressing. Downtime is thus reduced because damage of the sieve elements is avoided, which leads, of course, to an increase of the use of the entire disintegrating device.

A development of the above-described disintegrating device according to the invention is characterized in that a suspension is provided as component of the mount at the base comb where the sieve element is mounted swiveling, preferably in two different directions, for example with horizontal and vertical orientation. In particular the swiveling mount in two different directions has the result that the sieve elements can dodge larger jamming elements not only in vertical direction, but also in horizontal direction. This further reduces the failure susceptibility of the device as the sieve elements can recede vertically as well as horizontally in order to dodge these interfering elements.

A particularly clever modification of the invention suggests that the suspension is a cardanic suspension for the sieve element. This cardanic suspension is particularly suited for the above-described dodging movements in two different directions. In addition a cardanic suspension is particularly little prone to failure, if at all.

The disintegrating device according to the invention is also characterized in that a spring system, consisting of at least one spring, is provided interacting with the suspension and forming the spring mount of the sieve element.

It has proved here to be an advantage when the spring system is provided spaced parallel to the suspension. This creates enough space in the device for arranging the spring.

Furthermore it is advantageous when a pressure spring is provided as a spring, and/or the spring is arranged at least partly in a spring sleeve. Of course this reduces the free movement of the spring or the spring mount altogether.

It is another aspect of the disintegrating device according to the invention that at the base comb a preferably replaceable holding device is provided where the suspension, the spring system, and the sieve element are arranged interchangeably. Thus the entire holding device, if necessary even with installed sieve elements, can be dismounted from the base comb and mounted again. Thus entire assembles can be supplied that may be replaced in an arranged single case. Also for repair reasons differently designed assemblies can be provided. Single suspensions or a single replacement of possibly damaged sieve elements is thus possible.

The disintegrating device according to the invention is characterized according to a development in that the spring system comprises an adjustment device by means of which the preload force of the spring and/or the angle of attack of the sieve element can be set.

Of course it is also provided according to the invention that at the disintegrating device a number of sieve elements are arranged at the holding device, and the sieve elements are provided such that they can be installed or dismantled along with the holding device as a common assembly.

Furthermore, it is an advantage when the sieve element as comb extension element follows or is adjusted to the radius of the disintegrating roller.

An advantageous development of the invention suggests that the distance of the sieve element to the disintegrating roller can be set. For example, this allows determining the size for the material to be disintegrated, or to determine how large the material has to be that has to be disintegrated anew.

It has proved to be particularly advantageous when the disintegrating device according to the invention is configured such that a swiveling device is provided by means of which the base comb can be swiveled along an axle. Thus the space between the disintegrating tools and the counter blades can be altered, which is necessary for altering the size of the material to be disintegrated. At the same time, the base comb along with the counter blades and the sieve elements can be moved towards and away from the disintegrating roller. Besides the desired adjustment of distance, this feature of the device can also be used for cleaning the space between the rollers between the teeth if there is too much material adhering. This may happen, for example, when the material is very wet. Of course, this interferes with the disintegrating process altogether what can be eliminated with the above-described feature of the device.

A favorable development of the disintegrating device according to the invention is characterized in that the swiveling device is formed by at least one hydraulic cylinder arranged above a base comb axle and a housing axle in the disintegrating device. The attachment between the two axles and swiveling via the swiveling axle of the base comb leads to the intended option of changing the distance.

Furthermore it has turned out to be an advantage when the swiveling device comprises another hydraulic cylinder setting the distance to the disintegrating roller up to the stop. This avoids reliably that the base comb moves too close to the disintegrating roller.

According to the invention it has been found to be an advantage when a control is provided measuring the distance of the comb system to the disintegrating roller, sets it to a predetermined distance, and keeps it to this distance, and, if necessary, readjusts it.

The invention also suggests designing the counter blade of the disintegrating device according to the invention preferably as replaceable comb tooth or alternate tooth.

It is another aspect of the invention that a toothed bar is provided where the counter blade is arranged individually or as assembly along with a multitude of counter blades.

It has proved here to be an advantage when between the toothed bar and the counter blade designed as comb tooth a wear plate is provided. If necessary, this can be replaced when the wear is high. A premature replacement of the entire base comb is thus avoided.

A development of the disintegrating device according to the invention is characterized in that a preferably hydraulic locking system is provided for the counter blade.

Accordingly the invention suggests that the disintegrating device or the comb system comprises at least the base comb, the toothed bar with counter blades or alternate teeth, and the sieve device with the holding device and sieve elements as comb extension elements.

Preferably the sieve device of the disintegrating device according to the invention is designed like a basket. The individual sieve elements form the basket.

Furthermore, the invention suggests that the sieve device can be combined as system component with different disintegrating rollers having different diameters such that different disintegration tasks can be executed with one disintegrating device.

The disintegrating device according to the invention is furthermore characterized in that the position of the disintegrating roller and the sieve device in the device is orientated essentially horizontally, and/or the sieve device encumbers the disintegrating device in the bottom area in the direction of set up.

In the following the invention will be described by means of examples.

DETAILED DESCRIPTION OF THE INVENTION

Figure 1A:
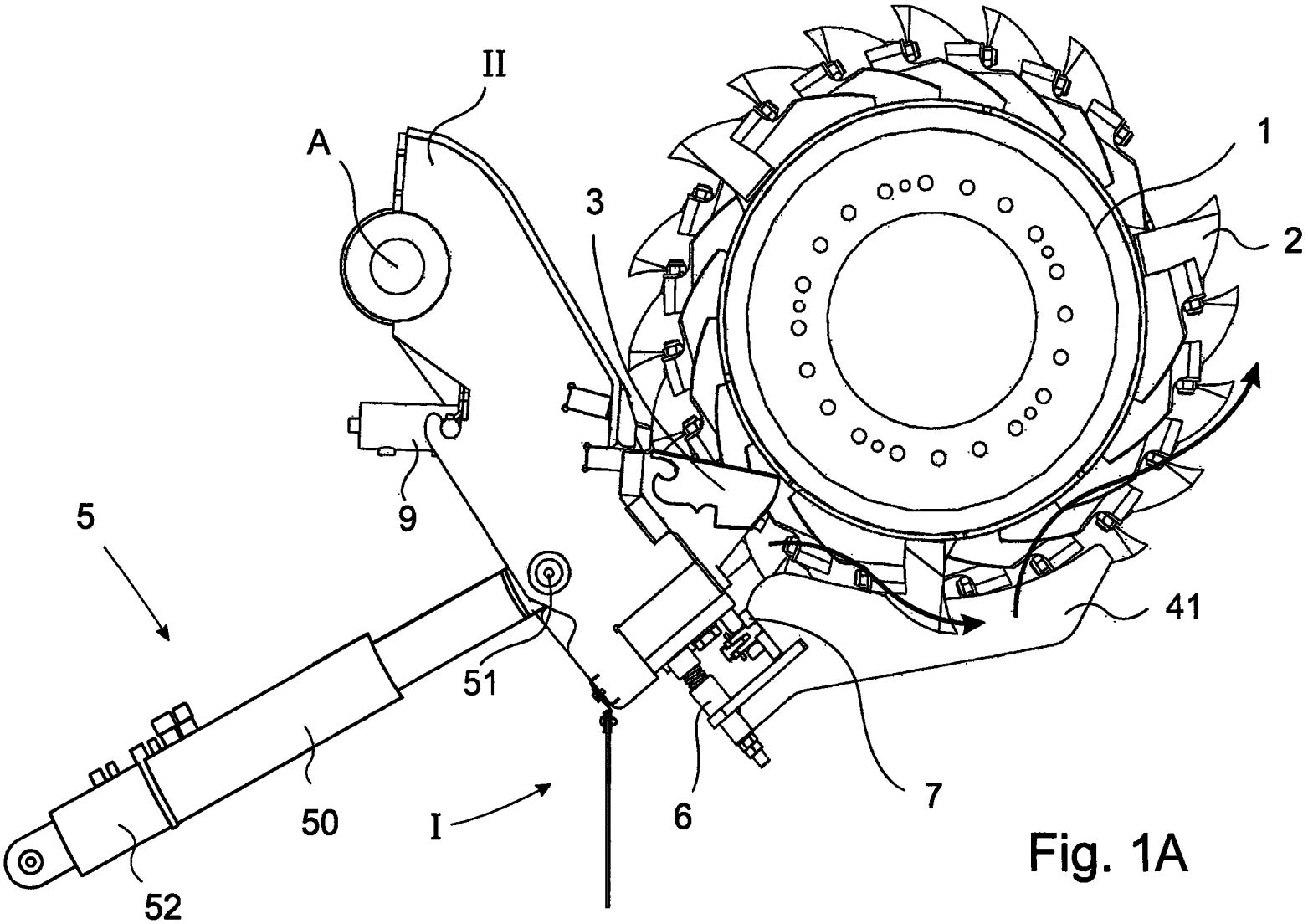
FIG. 1 consists of FIGS. 1A, 1B and 1C showing different views of details of the disintegrating device according to the invention.
Figure 1B:
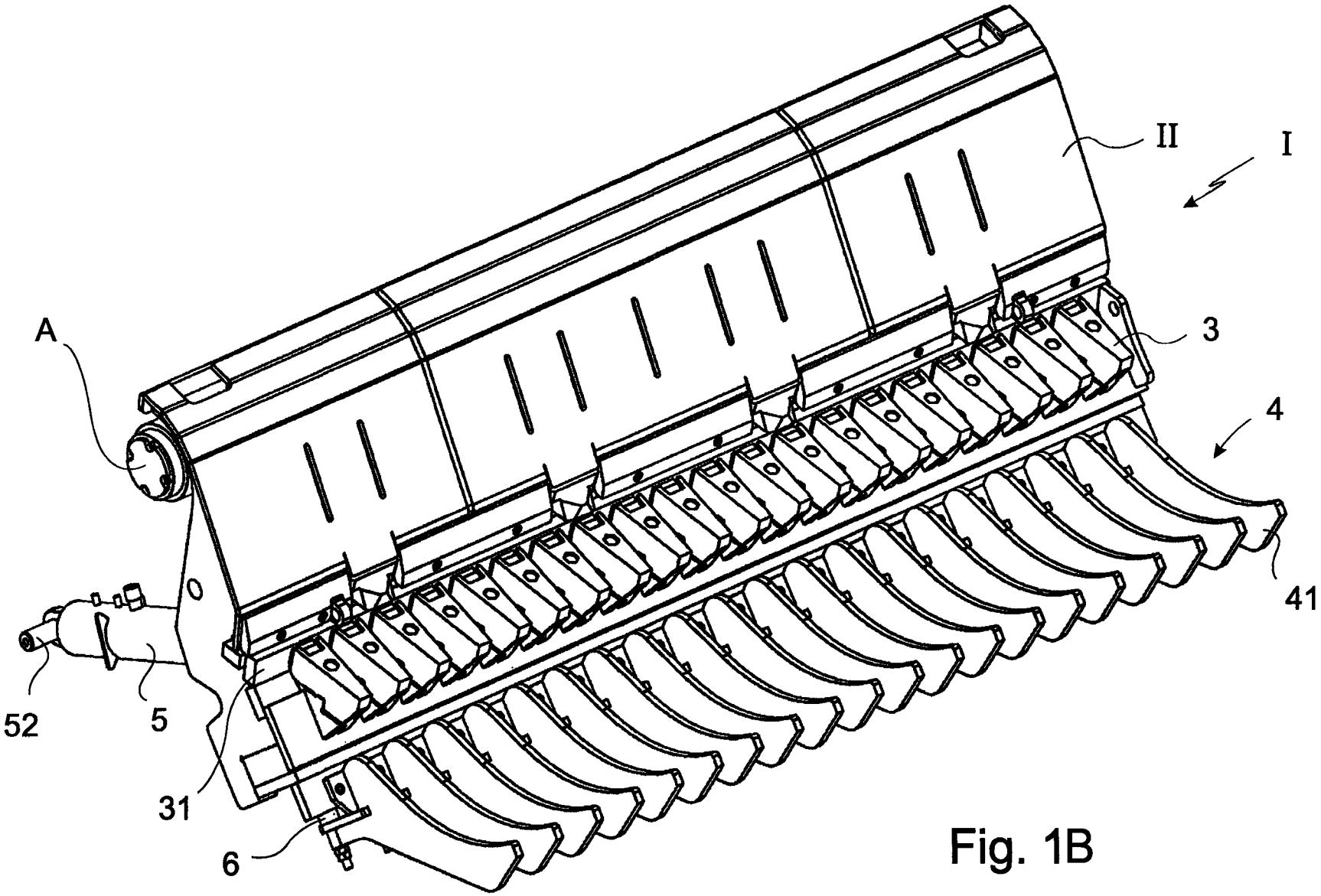
Figure 1C:
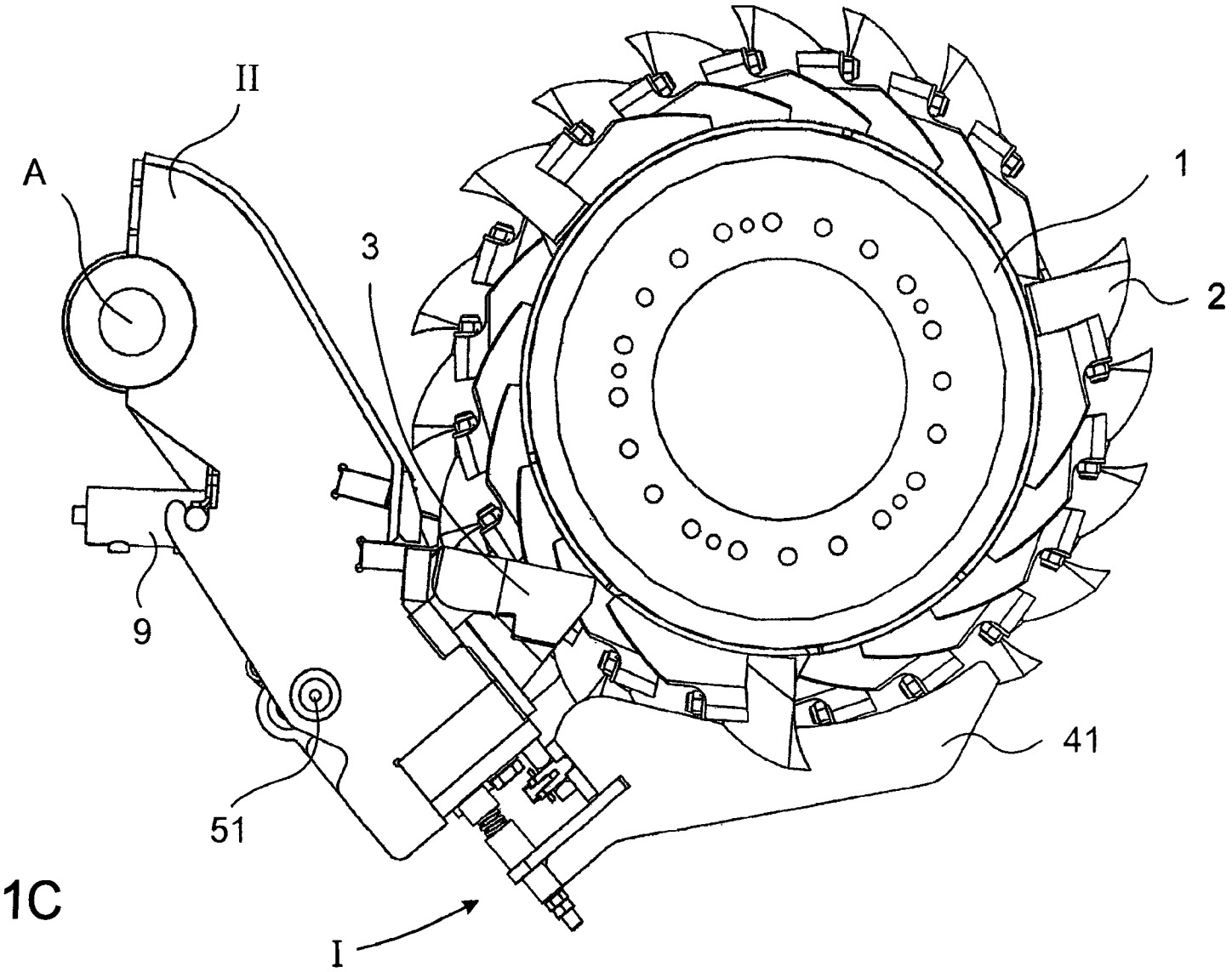
Figure 2:
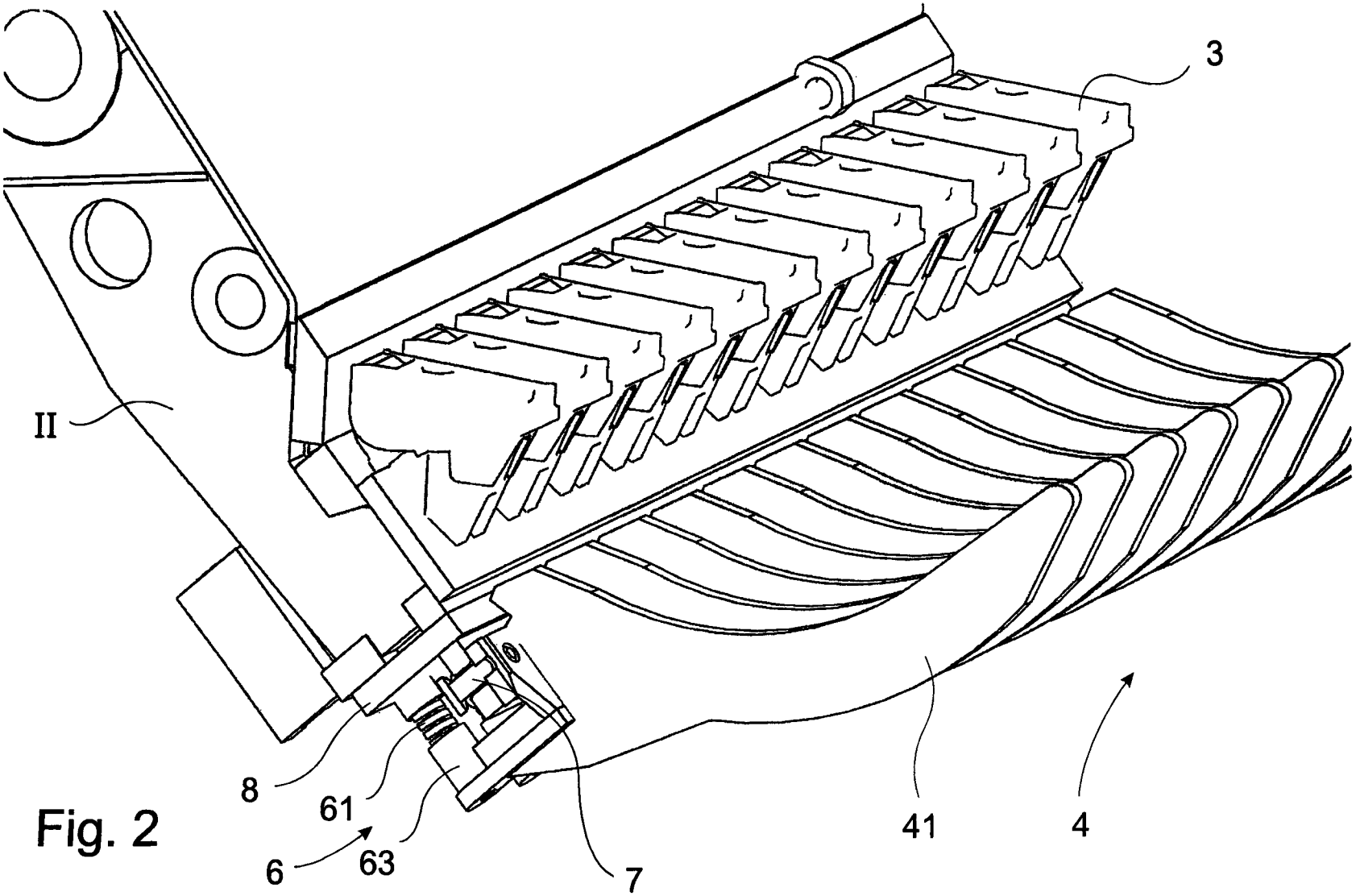
FIG. 2 is an enlarged representation of the area of the base comb with counter blades and sieve elements of the disintegrating device according to the invention, and FIG. 3 consists of FIGS. 3A, 3B and 3C showing further details of the suspension of the comb elements.
Figure 3A:
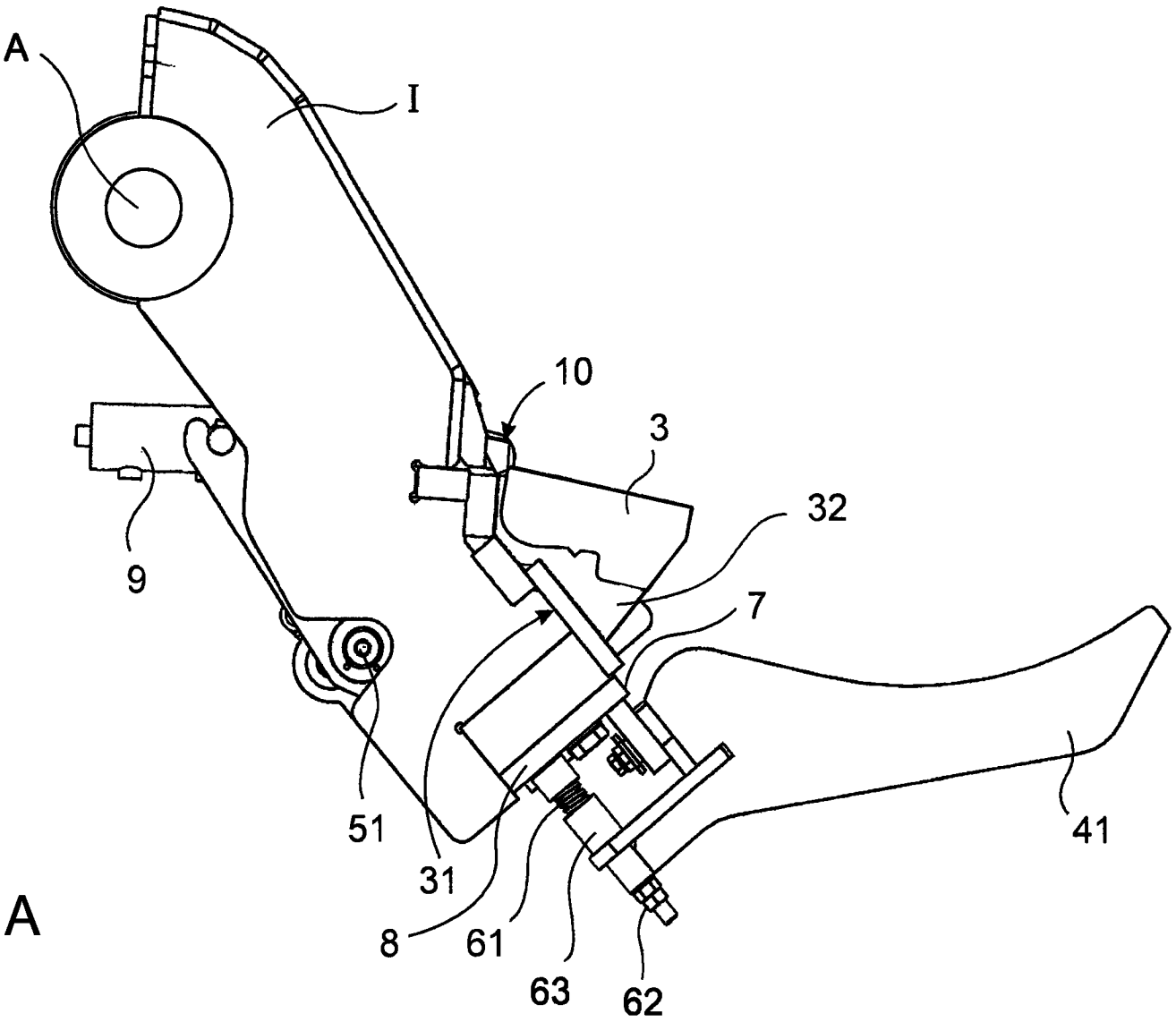
Figure 3B:
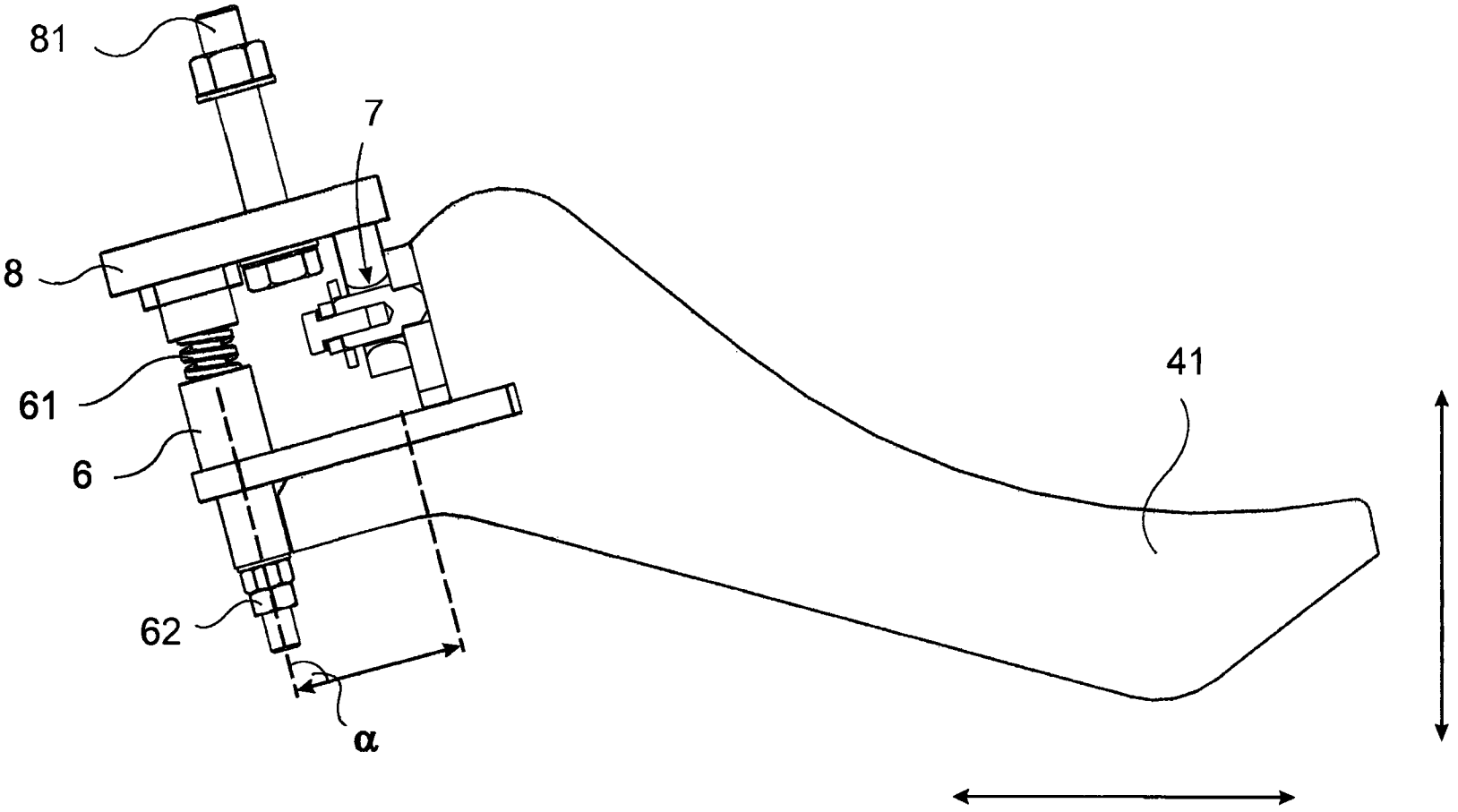
Figure 3C:
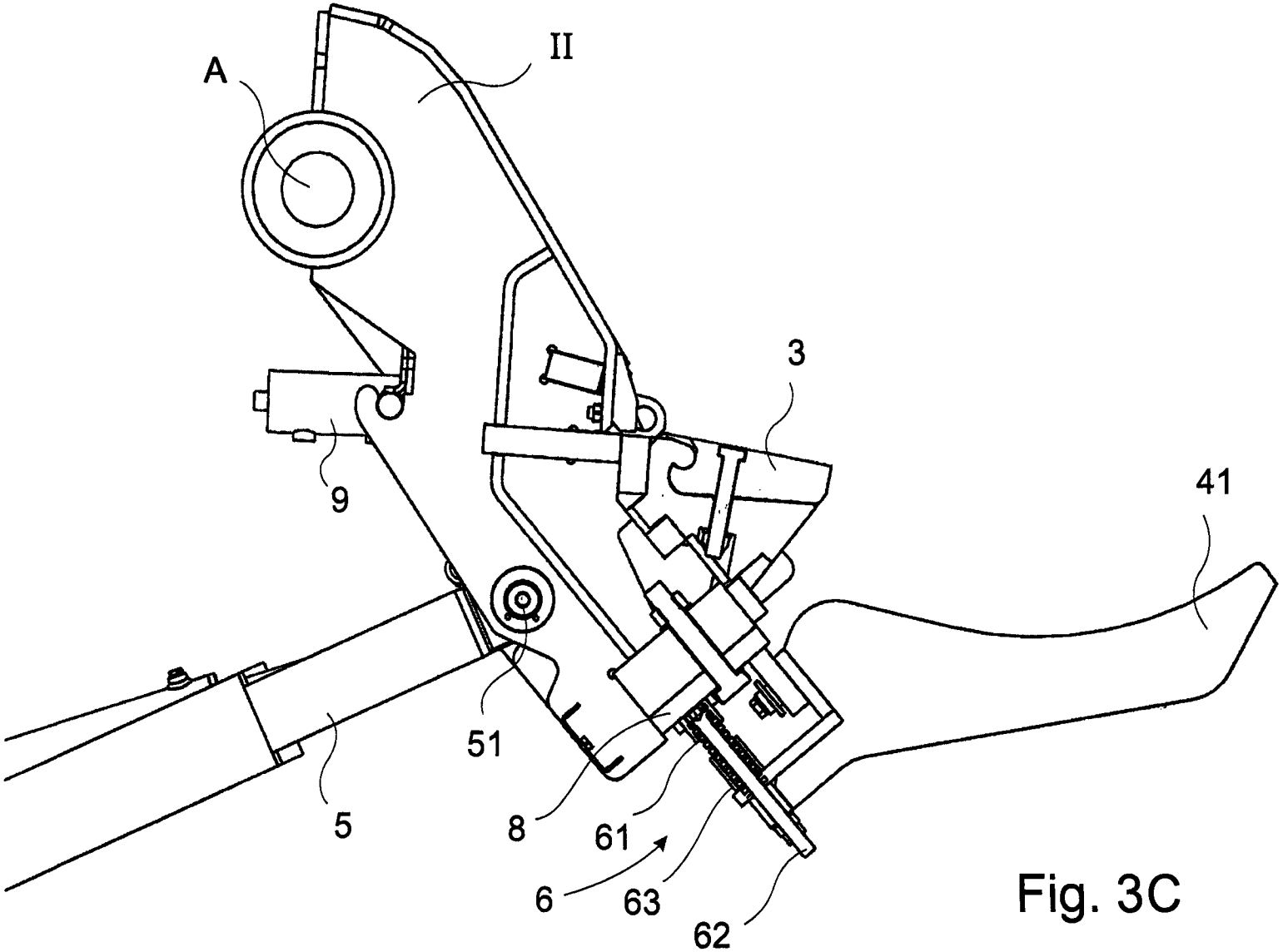

In the following an embodiment of the disintegrating device according to the invention will be described by means of the figures. It is pointed out that the drawn representation is only an example for a disintegrating device according to the invention which has to be understood by no means as restricting. Identical features in the drawings will be provided with identical reference numbers so that all drawings will be described complexly.

FIGS. 1A to 3C show side views and three-dimensional presentations of the base comb II provided with sieve elements 41 of the disintegrating device according to the invention. In FIGS. 1A and 1C the disintegrating roller 1 is shown with disintegrating tools 2 arranged thereon. The disintegrating roller 1 is arranged in a not shown frame as well as the base comb II with the elements arranged thereon that will be described later on. An arrow and reference number I schematically indicate the comb system according to the invention. It consists of a base comb II on which the counter blades 3 and the sieve elements 41 of the sieve device 4 are arranged. The base comb II can be swiveled via an axle A. The swiveling movement is executed by a swiveling device 5 formed by a hydraulic cylinder 50 attached in the device via a base comb axle 51 and a housing axle 52. The housing axle is provided here in the not shown frame of the disintegrating device. The sieve elements 41 are attached to a suspension 7, which is part of the mount, to the base comb II. The springy support is accomplished by the spring system 6 arranged, as well as the suspension 7, at a preferably replaceable holding device 8. Suspension 7 and spring system 6 are spaced parallel from each other which has the result that by means of an adjustment device 62 the preload force of the spring 61 as well as the angle of attack a of the sieve elements 41 can be changed. This is a big advantage as, for example, different material to be disintegrated can be reacted on accordingly, i. e. the angle and, if necessary, the preload force, can be set. Spring 61 is a pressure spring arranged at least partly in a spring sleeve 63. The suspension 7 of the sieve elements 41 is preferably a cardanic suspension. Of course, this is only one of several possible modifications for suspensions that is by no means limiting. The swiveling device 5 comprises another hydraulic cylinder 9, however, that acts in opposite direction of hydraulic cylinder 50. Hydraulic cylinder 9 sets the distance of the base comb II to the disintegrating roller 1 up to the stop. At the base comb II a toothed bar 31 is provided where the counter blades 3 are provided individually or as assembly with a multitude of counter blades 3. Between the toothed bar 31 and the counter blade 3 designed as comb tooth a wear plate 32 is provided that prevents the entire base comb II from being replaced when worn. Only the wear plate is replaced. The counter blades 3 are defined at the base comb by means of a locking device 10, preferably also hydraulic.

The invention has been described above by means of an example. However, the invention is not restricted to it. The claims filed now and to be filed later on along with the application are attempted formulations without prejudice for obtaining broader protection.

References in the sub-claims relate to the further design of the matter of the main claim through the characteristics of the respective sub-claim. These are however not to be understood as a waiver of independent subjective protection for the characteristics of the referred sub-claims.

Characteristics only disclosed in the description so far may now, in the course of proceedings, be claimed as being of inventive relevance, for example to distinguish from the state of the art.

The invention claimed is:

1. A disintegrating device with a comb system wherein the disintegrating device comprises at least one disintegrating roller mounted rotatably in a machine frame with at least one disintegrating tool arranged thereon, wherein the disintegrating device has at least one counter blade interacting with the at least one disintegrating tool, with at least one base comb on which the at least one counter blade is arranged, and at which at least one sieve element is a component of a sieve device, the sieve device encircles the disintegrating roller at least partly, wherein the sieve element is spring mounted at the base comb, wherein a suspension is provided as part of the mount at the base comb where the sieve element is pivotally mounted to swivel, wherein a spring system is provided consisting of at least one spring interacting with the suspension and forming the spring support of the sieve element, wherein a toothed bar is provided where the counter blade is provided individually or as an assembly altogether with a multitude of counter blades, wherein a replaceable holding device is provided at the base comb where the suspension, the spring system, and the sieve element are replaceably arranged, and wherein the comb system comprises at least the base comb, the toothed bar along with counter blades or alternate teeth, and the sieve device with the holding device and sieve elements as comb extension elements.

2. The disintegrating device according to claim 1, wherein the suspension is pivotally mounted to swivel in two different directions, horizontal and vertical.

3. The disintegrating device according to claim 2, wherein the suspension is a cardanic suspension for the sieve element and wherein the sieve element is suited for dodging movements in the two different directions.

4. The disintegrating device according to claim 1, wherein the spring system is provided spaced parallel to the suspension, and the spring is a pressure spring and is arranged at least partly in a spring sleeve.

5. The disintegrating device according to claim 1, wherein the spring system comprises an adjustment device by means of which the preload force of the spring and/or an angle of attack a of the sieve element can be set.

6. The disintegrating device according to claim 5, wherein a multitude of the sieve elements are arranged at the holding device, so that and the sieve elements along with the holding device are provided such that they can be mounted or dismounted altogether, wherein the sieve element as a comb extension element follows or is adapted to the radius of the disintegrating roller.

7. The disintegrating device according to claim 1, wherein the distance of the sieve element to the disintegrating roller can be set.

8. The disintegrating device according to claim 1, wherein, a swiveling device is provided by means of which the base comb can swivel via an axle, and wherein the swiveling device formed by at least one hydraulic cylinder which is arranged via a base comb axle and a housing axle in the disintegrating device, and wherein the swiveling device comprises another hydraulic cylinder that sets the distance to the disintegrating roller up to a stop.

9. The disintegrating device according to claim 1, wherein a control is provided which measures a distance of the comb system from the disintegrating roller, sets the distance to a predefined distance, keeps the distance, and readjusts the distance, if necessary.

10. The disintegrating device according to claim 1, wherein the counter blade is a replaceable comb tooth or an alternate tooth, and wherein a hydraulic locking device is provided for the counter blade.

11. The disintegrating device according to claim 1, wherein a wear plate is provided between the toothed bar and the counter blade.

12. The disintegrating device according to claim 1, wherein the sieve device is in a basket shape.

13. The disintegrating device according to claim 1, wherein the position of the disintegrating roller and the sieve device is orientated essentially horizontally in the device, or wherein the sieve device encircles the disintegrating roller in a bottom area in installation direction.

* * * * *